US008097087B2

(12) United States Patent
Mitake et al.

(10) Patent No.: US 8,097,087 B2
(45) Date of Patent: Jan. 17, 2012

(54) METHOD OF CLEANING SUPPORT PLATE

(75) Inventors: Tatsuhiro Mitake, Kawasaki (JP); Atsushi Miyanari, Kawasaki (JP); Yoshihiro Inao, Kawasaki (JP)

(73) Assignee: Tokyo Ohka Kogyo Co., Ltd., Kanagawa (JP)

( * ) Notice: Subject to any disclaimer, the term of this patent is extended or adjusted under 35 U.S.C. 154(b) by 0 days.

(21) Appl. No.: 12/837,790

(22) Filed: Jul. 16, 2010

(65) Prior Publication Data

US 2011/0017231 A1 Jan. 27, 2011

(30) Foreign Application Priority Data

Jul. 21, 2009 (JP) ..... 2009-170012

(51) Int. Cl.
*B08B 5/00* (2006.01)

(52) U.S. Cl. ..... 134/1.1; 134/1; 134/1.2; 134/1.3; 134/22.1; 134/26; 134/30; 134/42; 216/67; 219/121.69; 438/725

(58) Field of Classification Search ..... 216/67; 219/121.69; 438/725; 134/1, 1.1, 1.2, 1.3, 134/22.1, 26, 30, 42
See application file for complete search history.

(56) References Cited

U.S. PATENT DOCUMENTS

| | | | | |
|---|---|---|---|---|
| 7,207,339 | B2 * | 4/2007 | Chen et al. | 134/1.1 |
| 7,268,061 | B2 | 9/2007 | Miyanari et al. | |
| 7,534,469 | B2 * | 5/2009 | Satoh et al. | 427/248.1 |
| 2002/0189636 | A1 * | 12/2002 | Sun | 134/1.1 |
| 2005/0170612 | A1 | 8/2005 | Miyanari et al. | |
| 2006/0108330 | A1 * | 5/2006 | Lee et al. | 219/121.6 |
| 2006/0201910 | A1 * | 9/2006 | Getty et al. | 216/57 |
| 2007/0157414 | A1 * | 7/2007 | Yi et al. | 15/310 |
| 2008/0066778 | A1 * | 3/2008 | Matsushita et al. | 134/1.2 |
| 2008/0083715 | A1 * | 4/2008 | Kirmeier | 219/121.69 |
| 2009/0032056 | A1 * | 2/2009 | Tsunekawa | 134/1.3 |
| 2009/0065025 | A1 * | 3/2009 | Urbanowicz et al. | 134/1.1 |
| 2009/0173359 | A1 * | 7/2009 | Dictus | 134/1.1 |
| 2010/0024840 | A1 * | 2/2010 | Hsieh et al. | 134/1.1 |
| 2010/0192973 | A1 * | 8/2010 | Ueno et al. | 134/1.1 |

FOREIGN PATENT DOCUMENTS

| | | |
|---|---|---|
| JP | 62-235236 | 10/1987 |
| JP | 63-180393 | 7/1988 |
| JP | 9-227170 | 9/1997 |
| JP | 2005-191550 | 7/2005 |

* cited by examiner

*Primary Examiner* — Bibi Carrillo
(74) *Attorney, Agent, or Firm* — Wenderoth, Lind & Ponack, L.L.P.

(57) ABSTRACT

A method of cleaning a support plate according to which, while no waste solution is produced after cleaning the support plate, the support plate can be treated at low cost. The method of cleaning the support plate includes the step of removing an organic substance adhered to the support plate by putting the support plate in contact with oxygen plasma.

3 Claims, 2 Drawing Sheets

METHOD OF CLEANING SUPPORT PLATE

CROSS REFERENCE TO RELATED APPLICATIONS

This Nonprovisional application claims priority under 35 U.S.C. §119(a) on Patent Application No. 2009-170012 filed in Japan on Jul. 21, 2009, the entire contents of which are hereby incorporated by reference.

BACKGROUND OF THE INVENTION

I. Technical Field

The present invention relates to a method of cleaning a support plate that is attached to and supports a substrate, to thin the substrate.

II. Description of the Related Art

In recent years, there has been an increasing demand for higher integration and reduction in size and thickness of semiconductor chips to be mounted on electronic devices. Accordingly, the substrate that is a base of such semiconductor chips must be thinned, by grinding the substrate. However, this grinding weakens the strength of the substrate. This tends to crack and warp the substrate. Further, because a thinned substrate cannot be transferred automatically, such a substrate needs to be manually transferred. Therefore, handling of such a substrate cumbersome.

In order to solve this problem, a method for preventing the occurrence of cracking and warping of a substrate has been developed. According to the method, the substrate to be ground is attached to a glass support plate by use of an adhesive so that the strength of the substrate is maintained (See Japanese Patent Application Publication, Tokukai, No. 2005-191550 A (Publication Date: Jul. 14, 2005)).

However, in the method described in Japanese Patent Application Publication, Tokukai, No. 2005-191550 A (Publication Date: Jul. 14, 2005), in a case where a substance, such as an organic substance, is adhered to the support plate, a small gap is produced between the substrate and the support plate. This damages the substrate. Therefore, as pretreatment prior to attachment of the substrate, it is necessary to clean the support plate.

Typically, a support plate has a surface area that is equal to or more than a surface area of a substrate. Accordingly, if wirings are formed on the substrate being supported by such a support plate, metal sticks to an exposed peripheral portion of the support plate that is not covered by the substrate. Further, an adhesive remains on the support plate after the substrate is separated from the support plate. Therefore, for reusing the support plate, a substance such as metal and/or an organic substance that adheres to the support plate needs to be completely removed from the support plate after the substrate is separated from the support plate.

In general, metal and/or an organic substance each of which is adhered to a support plate can be removed by using a chemical such as acid, alkali, and/or an organic solvent. For example, the metal can be removed by use of aqua regia. Meanwhile, the organic substance can be removed by use of an organic solvent or acid.

As a method of cleaning a glass substrate, Japanese Patent Application Publication, Tokukaihei, No. 9-227170 A (Publication Date: Sep. 2, 1997) discloses a method according to which metal and/or an organic substance that is adhered to the glass substrate is removed by treating the glass substrate by use of a mixture of heated sulfuric acid and hydrogen peroxide solution.

Japanese Patent Application Publication, Tokukaishou, No. 62-235236 A (Publication Date: Oct. 15, 1987) discloses a method according to which a substance adhering a glass substrate is removed by cleaning the glass substrate by use of acid.

Further, Japanese Patent Application Publication, Tokukaishou, No. 63-180393 A (Publication Date: Jul. 25, 1988) discloses a method for removing a metal film. According to this method, when a metal film formed on a circuit substrate is melted and removed by laser light irradiation onto the metal film, a portion to be a target of the laser light irradiation is covered by liquid that transmits laser light so that the circuit substrate is not damaged due to heat of the laser light.

SUMMARY OF INVENTION

However, according to conventional techniques disclosed in Japanese Patent Application Publication, Tokukai, No. 2005-191550 A (Publication Date: Jul. 14, 2005), Japanese Patent Application Publication, Tokukaihei, No. 9-227170 A (Publication Date: Sep. 2, 1997), Japanese Patent Application Publication, Tokukaishou, No. 62-235236 A (Publication Date: Oct. 15, 1987), and Japanese Patent Application Publication, Tokukaishou, No. 63-180393 A (Publication Date: Jul. 25, 1988), though an organic substance and a metal film each adhered to a support plate can be removed, waste solution is produced after cleaning of the support plate. Accordingly, in the conventional techniques, treatment of such waste solution is troublesome and costly. In addition, in a case where a chemical such as acid, hydrogen peroxide solution, and/or an organic solvent is used, cleaning costs become high.

The present invention is attained in view of the above problems. An object of the present invention is to attain a method of cleaning a support plate that produces no waste solution after cleaning of the support plate and that allows treatment at low cost.

In order to solve the problem described above, the present invention relates to a method of cleaning a support plate attached, to and supporting a substrate such that the substrate is capable of being thinned, the method includes the step of: removing an organic substance adhered to the support plate by putting the support plate in contact with oxygen plasma.

According to the above configuration, an organic substance adhered to a support plate can be removed at low cost, while no waste solution is produced after cleaning of the support plate.

A method of the present invention relates to cleaning a support plate attached to and supporting a substrate, such that the substrate is capable of being thinned, the method is configured to include the step of: removing an organic substance adhered to the support plate by putting the support plate in contact with oxygen plasma.

This provides an effect such that a support plate can be cleaned at low cost while no waste solution is produced after cleaning of the support plate.

For a fuller understanding of the nature and advantages of the invention, reference should be made to the ensuing detailed description taken in conjunction with the accompanying drawings.

BRIEF DESCRIPTION OF THE DRAWINGS

FIG. 1(*a*) is a diagram schematically showing a perforated support plate. FIG. 1(*b*) is a cross sectional view taken along a thickness direction of a support plate having a protective film formed on a side surface section and an edge section, schematically showing the support plate.

DETAILED DESCRIPTION OF INVENTION

Figure 1:
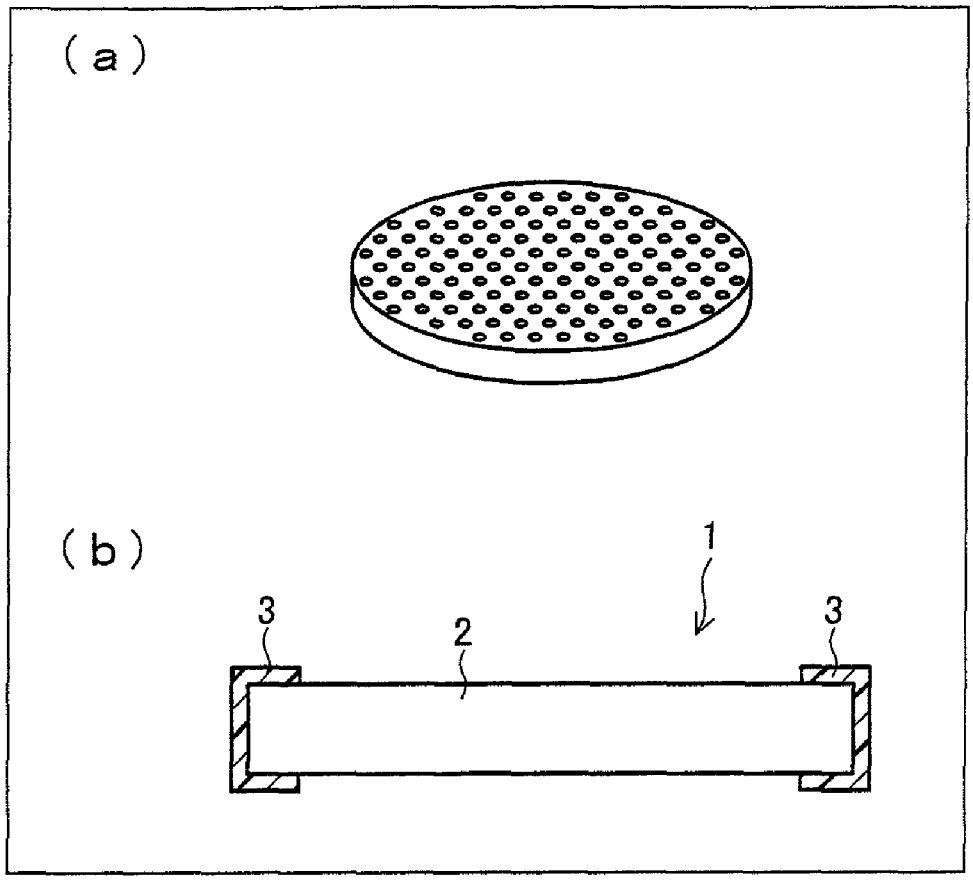
FIG. 1 is a diagram showing an exemplary support plate to be a target of a treatment of the present invention.

The following describes an embodiment of the present invention, however the present invention is not limited to this embodiment.

Note that "A to B" indicating a range of a numerical value means "A or more and B or less" in the present specification.

[1. Method of Cleaning Support Plate]

The following describes a method of cleaning a support plate according to the present invention. The method of cleaning the support plate according to the present invention includes a step (organic substance removing step) of removing an organic substance adhered to the support plate by putting the support plate in contact with oxygen plasma. Further, the method of cleaning the support plate according to the present invention preferably includes a step (metal removing step) of removing metal adhered to the support plate by laser light irradiation onto the support plate, in addition to the organic substance removing step. Further, the order of the "organic substance removing step" and the "metal removing step" can be arranged in any order as long as an organic substance and metal can be removed. That is, the metal removing step may come after the organic substance removing step, or the organic substance removing step may come after the metal removing step.

Here, the following describes the "organic substance removing step" and the "metal removing step".

(1-1. Organic Substance Removing Step)

The organic substance removing step is a step of removing an organic substance adhered to the support plate by putting the support plate in contact with oxygen plasma. In the organic substance removing step, a conventionally known oxygen plasma apparatus can be used as means for putting the support plate in contact with the oxygen plasma. Typical types of the oxygen plasma apparatus include a single plate type and a batch type. However, the present invention is not limited to these types.

In the organic substance removing step, any conditions may be used for treatment by oxygen plasma, as long as an organic substance can be removed under the conditions. However, in the case of the batch type oxygen plasma apparatus, an output of the oxygen plasma put in contact with the support plate is typically in a range of 500 W to 2000 W, and preferably in a range of 800 W to 1500 W. Further, in the case of the single plate type oxygen plasma apparatus, the output is typically in a range of 1000 W to 3000 W, and preferably in a range of 1500 W to 2500 W.

A pressure of the oxygen plasma put in contact with the support plate is typically in a range of 40 Pa to 266 Pa and preferably in a range of 67 Pa to 200 Pa.

In the case of the batch type oxygen plasma apparatus, an oxygen flow rate of the oxygen plasma put in contact with the support plate is typically in a range of 100 sccm to 1000 sccm, and preferably in a range of 200 sccm to 800 sccm. In the case of the single plate type oxygen plasma apparatus, the oxygen flow rate is typically in a range of 1000 sccm to 5000 sccm, and preferably in a range of 2000 sccm to 4000 sccm. Note that the unit "sccm" is an abbreviation of "standard cc/min" and indicates an oxygen flow rate standardized at a constant temperature at 1 atm (under atmospheric pressure of 1013 hPa).

In the case of the batch type oxygen plasma apparatus, a treatment time by the oxygen plasma put in contact with the support plate is typically in a range of 20 minutes to 90 minutes, and preferably in a range of 30 minutes to 60 minutes. In the case of the single plate type oxygen plasma apparatus, the treatment time is typically in a range of 5 minutes to 30 minutes, and preferably in a range of 10 minutes to 20 minutes.

In one embodiment, in a case where the batch type oxygen plasma apparatus is used, treatment conditions are, for example, Output: 900 W, Pressure: 133 Pa (1 Torr), Oxygen Flow Rate: 350 sccm, and Treatment Time: 60 minutes.

In another embodiment, in a case where the single plate type oxygen plasma apparatus is used, treatment conditions are, for example, Output: 2000 W, Pressure: 67 Pa (0.5 Torr), Oxygen Flow Rate: 3000 sccm, Treatment Time: 10 minutes; and Stage Temperature: 240° C.

As an oxygen plasma treatment method may be in any method as long as an organic substance can be removed by the method. For example, the oxygen plasma treatment method may be a single-plate treatment method or a batch treatment method. Further, both sides of the support plate may be put in contact with oxygen plasma. Alternatively, only one side of the support plate may be put in contact with oxygen plasma. In the case of the single-plate treatment method, the support plate is preferably pinned up when both sides of the support plate are put in contact with oxygen plasma.

(1-2. Metal Removing Step)

The metal removing step is a step of removing metal adhered to the support plate by laser light irradiation onto the support plate. The metal to be removed in the metal removal step is intended to mean metal that is generally used for formation of a circuit on a substrate. Examples of such metal can be Al, Ti, Zr, Cd, Au, Ag, Pt, Pd, Zn, Ni, Cu, and Sn.

Laser light used in the laser light irradiation in the metal removing step may be any laser light having an oscillation wavelength at a high peak power.

The laser light irradiation may be performed under any conditions as long as the metal can be removed under the conditions. For example, a frequency of the laser light in the laser light irradiation onto the support plate is preferably in a range of 10 kHz to 100 kHz, in a case where a laser wavelength is approximately 1000 nm. Further, in a case where the laser wavelength is approximately 500 nm, the frequency of the laser light is typically in a range of 1 Hz to 60 Hz, and preferably in a range of 20 Hz to 40 Hz.

In a case where the laser wavelength is approximately 1000 nm, an irradiation output of the laser light for irradiation onto the support plate is preferably in a range of 10 mJ to 200 mJ. Further, in a case where the laser wavelength is approximately 500 nm, the irradiation output is typically in a range of 10 mJ to 100 mJ, and preferably in a range of 20 mJ to 30 mJ.

In one embodiment, in a case where a laser having a laser wavelength of 1000 nm is used as a laser irradiation apparatus, treatment conditions are Laser Output: 160 mJ, and Frequency: 50 kHz.

In another embodiment, in a case where a laser having a laser wavelength of 500 nm is used as the laser irradiation apparatus, treatment conditions are Laser Output: 25 mJ, and Frequency: 30 Hz.

A laser light irradiation method may have any conditions as long as metal adhered to the support plate can be removed under the conditions. Note that, in view of preventing removed metal from adhering to another position, the laser light irradiation is performed onto the support plate more preferably from a backside of the support plate. The backside is opposite to a surface of the support plate to which surface the metal adheres. Further, the irradiation method may be a single-plate irradiation method or a batch irradiation method.

Note that the cleaning method of the present invention is intended to treat any support plate that is attached to a substrate being to be thinned for supporting the substrate. Accordingly, the support plate may be made of any material as long as the material has sufficient strength for supporting a substrate attached to the support plate. Examples of the material of the support plate are glass, metal, ceramic, or silicon.

Further, a configuration of the support plate to be treated is not specifically limited. The following describes an exemplary support plate to be a target of a treatment of the present invention, with reference to FIG. 1. FIG. 1(*a*) is a diagram schematically showing a perforated support plate. FIG. 1(*b*) is a cross sectional view taken along a thickness direction of a support plate having a protective film formed on a side surface section and an peripheral section, schematically showing the support plate.

As shown in FIG. 1(*a*), a perforated support plate means a support plate provided with a plurality of through holes penetrating the support plate in a thickness direction of the support plate. More specifically, the perforated support plate has through holes that are formed at a pitch in a range of 0.5 mm to 1.0 mm so as to have a diameter in a range of 0.3 mm to 0.5 mm. The through holes are used for supplying a solvent for dissolving an adhesive layer between the support plate and the substrate, when the substrate is separate from the support plate.

Further, in a support plate 1 shown in FIG. 1(*b*), a protective film 3 is formed on a side section and a peripheral section of a support plate main body 2.

The protective film 3 is an organic coating film having a film thickness in a range of 10 μm to 200 μm. This protective film 3 is made of an organic compound such as acrylic resin, epoxy resin, polyimide resin, novolak resin, or silica resin. The support plate 1 on which such a protective film 3 is formed can prevent etching and contamination of the support plate main body 2 in the processing steps of the substrate.

The support plate to be cleaned according to the method of cleaning a support plate according to the present invention may be either a support plate prior to attachment to a substrate or a support plate from which a substrate has been separated.

As described above, according to the method of cleaning a support plate according to the present invention, preferably, both sides of the support plate are put in contact with oxygen plasma.

According to the above configuration, an organic substance adhered to the both sides of the support plate can be removed.

According to the cleaning method of the present invention, the support plate is preferably a support plate from which the substrate has been separated.

An adhesive is adhered to the support plate from which the substrate has been separated. According to the configuration above, an organic substance can be removed from the support plate from which the substrate has been separated.

According to the method of cleaning the support plate according to the present invention, the method preferably includes a metal removing step of removing metal adhered to the support plate by laser light irradiation onto the support plate.

According to the above configuration, no waste solution is produced after cleaning the support plate. In addition, the metal adhered to the support plate can be removed at low cost.

According to the method of cleaning the support plate according to the present invention, it is preferable to perform the metal removing step after the organic substance removing step.

According to the above configuration, no waste solution is produced after cleaning the support plate. In addition, the support plate can be cleaned at low cost.

According to the method of cleaning the support plate of the present invention, preferably, the laser light irradiation is performed onto the support plate from a backside of the support plate, the backside being opposite to a surface of the support plate to which surface the metal adheres.

According to the above configuration, it is possible to prevent a sublimed substance from scattering to a surrounding area and/or adhering again to the support plate, as compared to a method according to which laser light irradiation is performed directly onto the metal.

[2. Support Plate Separating Apparatus]

Figure 3:
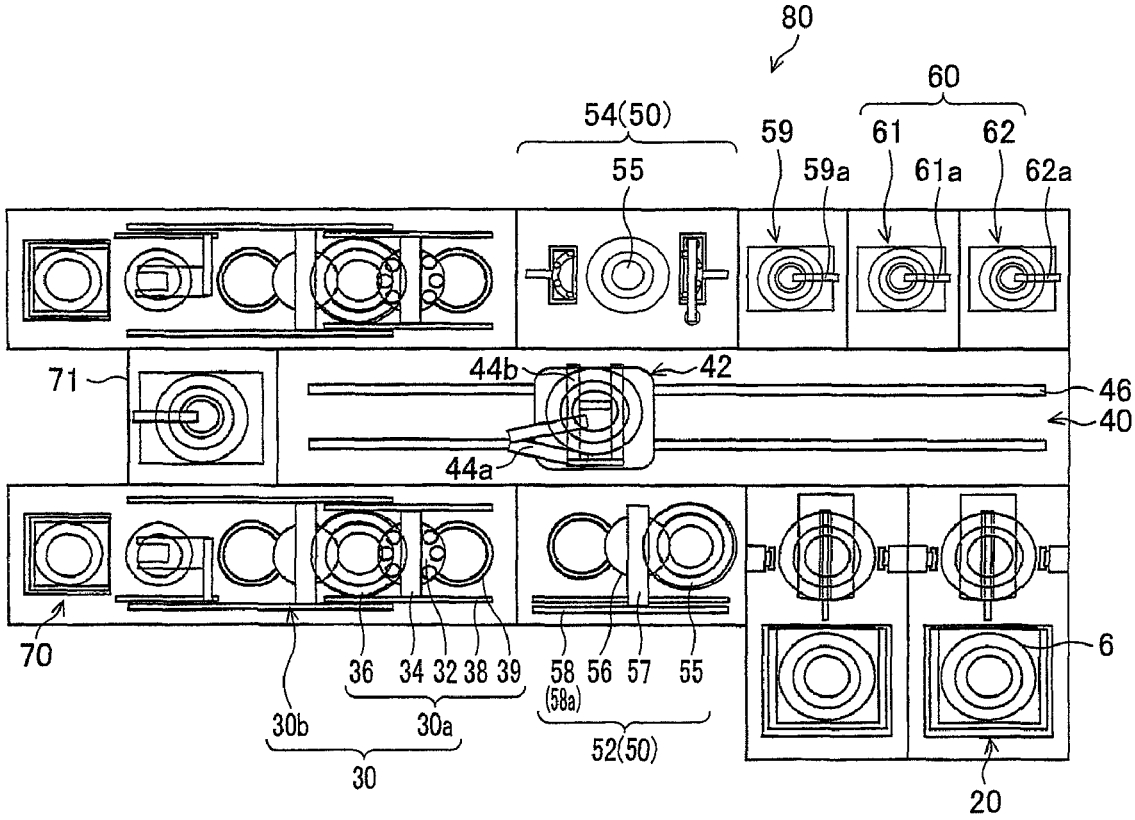
FIG. 3 is a diagram illustrating an exemplary configuration of a support plate separating apparatus according to an embodiment of the present invention.

The following describes an exemplary configuration of a support plate separating apparatus according to an embodiment of the present invention, with reference to FIG. 3. FIG. 3 is a diagram illustrating an exemplary configuration of a support plate separating apparatus 80. The support plate separating apparatus 80 is used to separate a substrate attached to a support plate and then cleaning the substrate and the support plate which are separated from each other.

More specifically, in the support plate separating apparatus 80, a substrate is separated from a support plate by separating means 30. The substrate that has been separated from the support plate is transferred to substrate cleaning means 50 by transfer means 40.

The substrate transferred to the substrate cleaning means 50 is cleaned by use of cleaning liquid in a first cleaning unit 52 and a second cleaning unit 54 so that an adhesive adhered to the substrate is removed. Then, in a third cleaning unit 59, the substrate is subjected to a dry treatment. This dry treatment removes an adhesive that has not been able to be removed by the cleaning liquid.

Meanwhile, the support plate from which the substrate has been separated is transferred to support plate cleaning means 60 by the transfer means 40.

From the support plate transferred to the support plate cleaning means 60, an organic substance adhered to the support plate is removed by an organic-substance removing unit 61 while metal adhered to the support plate is removed by a metal removing unit 62.

The following explains in detail the separating means 30, the transfer means 40, the substrate cleaning means 50, and the support plate cleaning means 60.

(Separating Means)

The separating mean 30 is configured to supply an adhesive layer with a solvent capable of dissolving the adhesive layer. Further, the separating means 30 separates a thinned substrate from the support plate after the adhesive layer has dissolved or an adhesive power of an adhesive is sufficiently weakened.

More specifically, the separating means 30 includes a dissolving treatment body 30*a* and a support plate transfer body 30*b*.

The dissolving treatment body 30*a* includes a solvent injection plate 32, and holding/moving means 34 that holds the solvent injection plate 32 and allowing movement of the solvent injection plate 32 in up and down directions, and a treatment stage 36 on which a treatment-target laminated body 8 is placed.

Figure 2:
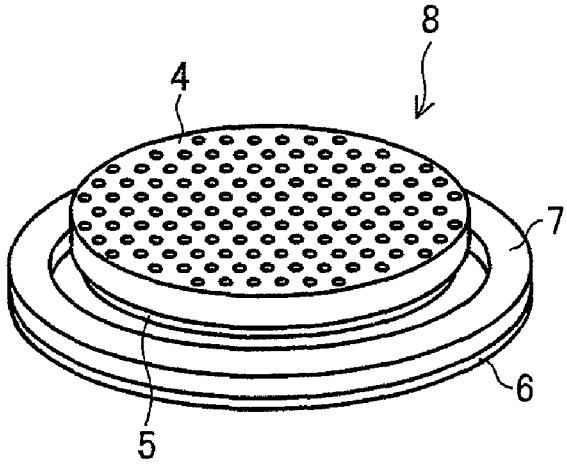
FIG. 2 is a diagram schematically illustrating an exemplary configuration of a treatment-target laminated body.

Here, an exemplary configuration of the treatment-target laminated body 8 is described with reference to FIG. 2. FIG. 2 is a diagram schematically illustrating an exemplary configuration of the treatment-target laminated body 8. In the treatment-target laminated body 8, a substrate 5 is attached to a support plate 4 by using an adhesive and moreover, a dicing tape 6 is attached to the substrate 5. The dicing tape 6 is held by a dicing frame 7 for preventing the dicing tape 6 from slaking. The substrate 5 has a surface to be attached to the support plate 4, and a circuit or the like is formed on this surface according to need.

The support plate is described in the section "1. Method Of Cleaning Support Plate" and therefore, an explanation thereof is omitted here.

Further, as shown in FIG. 3, the dissolving treatment body 30*a* preferably includes horizontal movement means 38 allowing in-plane (within a horizontal plane) movement of the solvent injection plate 32. This is for allowing the solvent injection plate 32 to standby at a position that does not overlap with the treatment stage 36 in a case where the separating means 30 is viewed in a plane. This configuration makes it possible to prevent the occurrence of unintended solvent supply in a case where the treatment-target laminated body 8 is placed on the treatment stage 36.

That is, the solvent injection plate 32 stands by at a standby position 39 that is different from a treatment position before the treatment-target laminated body 8 is placed on the treatment stage 36. Then, after the treatment-target laminated body 8 is placed on the treatment stage 36, the solvent injection plate 32 is moved to the right above the treatment-target laminated body 8 by the horizontal movement means 38. Subsequently, the solvent injection plate 32 is moved by the holding/moving means 34 so that the solvent injection plate 32 is apart from the treatment-target laminated body 8 at an appropriate distance. Then, treatment is started.

The solvent injection plate 32 has a counter surface facing the treatment-target laminated body 8. Though not shown, the counter surface of the solvent injection plate 32 is provided with a solvent supply hole for supplying a solvent via the through holes of the support plate and a solvent suction hole for sucking the solvent supplied. As long as it is possible to supply the solvent so that no solvent adheres to an expose portion of the dicing tape on an outer side of the support plate, configurations of the solvent supply hole and the solvent suction hole are not specifically limited. For example, on the counter surface of the solvent injection plate 32, the solvent supply hole can be provided at the center and the solvent suction hole can be provided at an outermost position from the center. This makes it possible to prevent the solvent from adhering to the exposed portion of the dicing tape, by concurrently supplying and sucking the solvent. In another example, a protrusion is provided on a periphery of the solvent injection plate 32 so as to shorten a distance between the solvent injection plate 32 and the treatment-target laminated body 8. This makes it possible to physically suppress scattering of the solvent. Further, the solvent injection plate 32 may be provided with an ultrasonic generator for accelerating permeation of the solvent into the adhesive.

The support plate from which the substrate is ready to be separated is transferred, by the support plate transfer body 30*b*, to a support plate storage section 70 for storing the support plate.

The "solvent" for dissolving the adhesive may be any conventionally known solvent such as a solvent used in adhesive liquid. Examples of such a solvent encompass: water; ketones such as acetone, methyl ethyl ketone, cyclohexanone, methyl isoamyl ketone, and 2-heptanone; polyhydric alcohols and derivatives thereof such as monomethyl ethers, monoethyl ethers, monopropyl ethers, monobutyl ethers, or monophenyl ethers of ethylene glycol, ethylene glycol monoacetate, diethylene glycol, diethylene glycol monoacetate, propylene glycol, propylene glycol monoacetate, dipropylene glycol, or dipropylene glycol monoacetate; cyclic ethers such as dioxane; and esters such as methyl lactate, ethyl lactate, methyl acetate, ethyl acetate, butyl acetate, methyl pyruvate, ethyl pyruvate, methyl methoxy propionate, and ethyl ethoxy propionate; and mixtures thereof.

These solvents can be selected as appropriate depending on properties of an adhesive to be dissolved. Particularly, in a case where an acrylic adhesive is used, propylene glycol monomethyl ether acetate (PGMEA) or 2-heptanone (MAK) is preferably used as the solvent. Meanwhile, in a case where a polyvinyl alcohol adhesive is used, water is preferably used as the solvent.

Note that preferably, the support plate separating apparatus 80 is provided with a plurality of dissolving treatment bodies 30*a* for improving an efficiency of separation treatment. Further, when the plurality of dissolving treatment bodies 30*a* are provided, the dissolving treatment bodies 30*a* are preferably positioned so as to sandwich a traveling path 46 of the transfer means 40 as shown in FIG. 3 for a highly efficient treatment.

(Substrate Cleaning Means)

The substrate cleaning means 50 includes the first cleaning unit 52, the second cleaning unit 54, and the third cleaning unit 59.

In the first cleaning unit 52, the substrate is cleaned by using cleaning liquid and an adhesive remaining on the substrate is removed. In the second cleaning unit 54, further cleaning with use of cleaning liquid and drying are performed. Subsequently, in the third cleaning unit 59, after the cleaning in the second cleaning unit 54, if an adhesive is still remaining on the substrate, the adhesive is removed by a dry treatment. In this way, by providing a plurality of cleaning units, sophisticated cleaning (cleaning for obtaining a clean surface) can be achieved. The transfer means 40 transfers the substrate among the first cleaning unit 52, the second cleaning unit 54, and the third cleaning unit 59.

More specifically, the first cleaning unit 52 is configured to include a cleaning plate 56 and a holding/moving means 57 that holds the cleaning plate 56 and that is movable in up and down directions. The cleaning plate 56 is a counter plate that has a counter surface facing a treatment-target surface of the substrate. Though not shown, this counter surface of the cleaning plate 56 is provided with a cleaning liquid supply hole for supplying the cleaning liquid to the substrate and a cleaning liquid suction hole for sucking the supplied cleaning liquid.

In the first cleaning unit 52, the substrate and the cleaning plate 56 are arranged to face each other. Then, while the cleaning liquid is supplied (dropped), the cleaning liquid having been used for cleaning is sucked. This makes is possible to prevent the cleaning liquid from scattering onto the dicing tape. As the "cleaning liquid", a suitable solvent can be selected as appropriate from among exemplary solvents described in the section of "Separating Means".

Further, like the separating means 30, the first cleaning unit 52 preferably includes a horizontal movement means 58 that can move horizontally. Because the first cleaning unit 52 includes the horizontal movement means 58, the cleaning plate 56 can be kept standby at a position that does not overlap with a treatment stage 55 when the cleaning unit 52 is viewed in a plane. In the present embodiment, the horizontal movement means 58 includes a linear traveling path 58*a* and a moving mechanism along the traveling path 58*a*. However, the horizontal movement means 58 can be configured in any way as long as the horizontal movement means 58 can transfer the cleaning plate 56 between a standby position and a treatment position.

The counter surface of the cleaning plate 56 preferably has the substantially same size and shape as a treatment-target surface of the substrate. This makes it possible to simultaneously subject the whole treatment-target surface of the substrate to a cleaning treatment. This leads to an efficient and uniform cleaning treatment in the treatment-target surface.

The second cleaning unit 54 is configured to further clean the substrate for which cleaning has been completed in the first cleaning unit 52 and to ultimately dry the substrate. The second cleaning unit 54 may be configured in any way as long as the second cleaning unit 54 has a configuration capable of performing cup cleaning.

The third cleaning unit 59 is configured to be capable of putting the substrate in contact with oxygen plasma. As shown in FIG. 3, the third cleaning unit 59 includes an oxygen plasma generating apparatus 59*a*. By putting the substrate in contact with oxygen plasma, the third cleaning unit 59 can remove the adhesive remaining on the substrate having been cleaned in the second cleaning unit 54.

The oxygen plasma generating apparatus 59*a* may be any conventionally know oxygen plasma apparatus. The oxygen plasma generating apparatus 59*a* may be, for example, the batch type or the single plate type.

In this way, the adhesive remaining on the substrate is removed by the third cleaning unit 59. Then, the substrate is diced into individual chips by a dicing apparatus (not shown).

(Support Plate Cleaning Means)

Support plate cleaning means 60 includes an organic substance removing unit 61 and a metal removing unit 62.

The organic substance removing unit 61 removes an organic substance adhered to the support plate. Meanwhile, the metal removing unit 62 removes metal adhered to the support plate.

The organic substance removing unit 61 is configured to be capable of putting the support plate in contact with oxygen plasma.

More specifically, the organic substance removing unit 61 includes an oxygen plasma generating apparatus 61*a*. This makes it possible to remove an organic substance adhered to the support plate by putting the support plate in contact with oxygen plasma. The oxygen plasma generating apparatus 61*a* may be any conventionally known oxygen plasma apparatus and may be, for example, the batch type or the single plate type.

Further, in the case of the single plate type oxygen plasma generating apparatus 61*a*, preferably, the organic substance removing unit 61 further includes a pinup apparatus. This makes it possible to put the support plate in contact with oxygen plasma, keeping the support plate pinned up. Therefore, both sides of the support plate can be put in contact with oxygen plasma and the organic substance can be efficiently removed.

The metal removing unit 62 is configured to be capable of performing laser light irradiation onto the support plate.

More specifically, the metal removing unit 62 includes a laser irradiation apparatus 62*a*. This makes it possible to perform laser light irradiation onto the support plate and to remove metal adhered to the support plate. The laser irradiation apparatus 62*a* may be any conventionally known laser irradiation apparatus.

The support plate is transferred from the organic substance removing unit 61 to the metal removing unit 62 by the transfer means 40.

The support plate separating apparatus 80 of the present embodiment is configured to remove metal in the metal removing unit 62 after removal of an organic substance in the organic substance removing unit 61. However, the order of removal of the organic substance and metal is not limited to the above order. The configuration may be such that, after metal is removed in the metal removing unit 62, an organic substance may be removed in the organic substance removing unit 61. In a case where no metal is adhered to the support plate, it is possible to perform only the removal of an organic substance in the organic substance removing unit 61.

(Transfer Means)

The transfer means 40 has a function to hold and transfer the treatment-target laminated body 8 to the separating means 30, a function to transfer the support plate from the separating means 30 to the organic substance removing unit 61, and a function to transfer the support plate from the organic substance removing unit 61 to the metal cleaning unit 62.

The transfer means 40 includes a transfer robot 42 and the traveling path 46 for realizing linear traveling. Specifically, the transfer robot 42 is capable of rotating around an axis of the transfer robot 42 at the center and includes two connected arms 44*a* and a hand 44*b*. The connected arms 44*a* expands/contracts by rotation at a joint. The hand 44*b* is provided to ends of the connected arms 44*a* and functions to hold the treatment-target laminated body 8 or the support plate. The transfer robot 42 makes it possible to transfer the treatment-target laminated body 8 or the support plate within a horizontal plane by the expansion/contraction of the connected arms 44*a* and the rotation around an axis 42*a*.

(Others)

As shown in FIG. 3, the support plate separating apparatus 80 of the present embodiment may further include an alignment section 71. The alignment section 71 correctly positions the treatment-target laminated body 8 taken out from a treatment-target laminated body storage section 20, before transfer of the treatment-target laminated body 8 to the separating means 30. Thereby, the alignment section 71 positions the treatment-target laminated body 8 in an appropriate position in the separating means. The alignment section 71 is preferably provided adjacent to the traveling path 46 of the transfer means 40 (so as to face the traveling path), because such a configuration allows highly precise alignment. This precise alignment becomes possible because, in such a configuration, the alignment can be performed based on three factors: a traveling direction (X) of the robot; an expanding direction (Y) of the arms; and rotation (θ) of the robot. Note that the alignment section 71 may also be preferably provided on an extended line of the traveling path of the transfer means 40, in consideration of an advantage in, for example, efficient space utilization and an equal distance from each of the plurality of separating means for transfer of the treatment-target laminated body 8 after the alignment.

The present invention is not limited to the description of the embodiments above, but may be altered by a skilled person within the scope of the claims. An embodiment based on a proper combination of technical means disclosed in different embodiments is encompassed in the technical scope of the present invention.

EXAMPLES

The following concretely describes the present invention by using Examples. However, the present invention is not limited to these Examples.

(Support Plate for Evaluation)

In each of Examples 1 through 3 employed, as a support plate for evaluation, a dried support plate has been used in a semiconductor production process and a substrate has been separated from the support plate. To the support plate for evaluation, an adhesive as an organic substance and aluminum, copper, gold and the like as metal were adhered. The support plate for evaluation had a size of 6 inches.

(Process Flow)

In Example 1, after the organic substance removing step was performed, the metal removing step was performed. In Example 2, only the metal removing step was performed. In Example 3, only the organic substance removing step was performed.

(Evaluation Method)

Removal of the organic substance and the metal were checked by visual observation.

Example 1

Organic Substance Removing Step

As the oxygen plasma generating apparatus, a batch-type OPM-EM100 (manufactured by Tokyo Ohka Kogyo Co., Ltd.) was used. As a treatment method, the batch treatment method was employed. Oxygen plasma was put in contact with both sides of the support plate. The following shows treatment conditions.

Output: 900 W

Pressure: 133 Pa

Oxygen Flow Rate: 350 sccm

Treatment Time: 60 min (Metal Removing Step)

As a laser irradiation apparatus, YAG Laser (manufactured by V-Technology Co., Ltd.) was used. As a treatment method, the batch treatment method was used. Laser light irradiation was performed onto the support plate from a backside of the support plate. The backside was opposite to a surface of the support plate to which surface the metal adhered. The following shows treatment conditions.

Frequency: 30 Hz

Irradiation Output: 25 mJ

Wavelength: 532 nm

Removal of the organic substance and the metal were checked by visual observation after the metal removing step. Table 1 shows a result of the visual observation.

Example 2

Metal Removing Step

As a laser irradiation apparatus, $YVO_4$ Laser (MD-V9910, laser wavelength: approximately 1000 nm, manufactured by Keyence Corporation) was used. As a treatment method, the batch treatment method was used. Laser light irradiation was performed directly onto a surface where the metal was adhered to the support plate. The following shows treatment conditions.

Frequency: 50 Hz

Irradiation Output: 160 mJ

Wavelength: 1064 nm

Removal of the metal was checked by visual observation after the metal removing step. Table 1 shows a result of the visual observation.

Example 3

Organic Substance Removing Step

As the oxygen plasma generating apparatus, TCA-7822 (manufactured by Tokyo Ohka Kogyo Co., Ltd.) was used. A treatment method was the single-plate treatment method. Oxygen plasma was put in contact with both sides of the support plate. The following shows treatment conditions.

Output: 2000 W

Pressure: 67 Pa

Oxygen Flow Rate: 3000 sccm

Treatment Time: 10 min

Stage Temperature: 240° C.

Removal of the organic substance was checked by visual observation after the organic substance removing step. Table 1 shows a result of the visual observation.

(Results)

TABLE 1

| | Results of Visual Observation | |
|---|---|---|
| | Organic Substance | Metal |
| Example 1 | ✓ | ✓ |
| Example 2 | | ✓ |
| Example 3 | ✓ | |

The check "√" in Table 1 indicates that no adherence of the organic substance and the metal was observed. Under the treatment conditions of Examples 1 through 3, the organic substance and the metal each adhered to the support plate could be removed.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

According to the method of cleaning a support plate of the present invention, the support plate can be cleaned at low cost while no waste solution is produced after cleaning of the support plate. This method of cleaning the support plate according to the present invention is widely utilized in all electronics industries using a support plate.

The invention claimed is:

1. A method of cleaning a support plate, the support plate being a support plate prior to attachment to a substrate or a support plate from which a substrate has been separated, the method consisting of:

adhering a metal and an organic substance to the support plate, the metal being at least one of Al, Ti, Zr, Cd, Au, Ag, Pt, Pd, Zn, Ni, and Cu;

removing the organic substance adhered to the support plate by putting the support plate in contact with oxygen plasma; and removing the metal adhered to a surface of a front side of the support plate by irradiating laser light onto the support plate, wherein said removing metal adhered to the surface of the front side of the support plate by irradiating laser light onto the support plate includes irradiating laser light onto the support plate such that the laser light is directed from a backside of the support plate, the backside of the support plate being opposite the front side of the support plate.

2. The method of cleaning the support plate as set forth in claim 1, wherein:

said putting the support plate in contact with oxygen plasma is putting both sides of the support plate in contact with oxygen plasma.

3. The method of cleaning the support plate as set forth in claim 1, wherein:

said removing the metal is performed after said removing the organic substance.

* * * * *